US007364491B2

(12) United States Patent
Updyke

(10) Patent No.: US 7,364,491 B2
(45) Date of Patent: Apr. 29, 2008

(54) SPORTS BRA WITH SECURE POCKET AND ELECTRONIC DEVICE CORD SECURING OPENING AND LOOP

(76) Inventor: Lauren Grace Updyke, 112 Cranwell Ct., Apex, NC (US) 27502

( * ) Notice: Subject to any disclaimer, the term of this patent is extended or adjusted under 35 U.S.C. 154(b) by 0 days.

(21) Appl. No.: 11/489,183

(22) Filed: Jul. 19, 2006

(65) Prior Publication Data

US 2008/0032600 A1 Feb. 7, 2008

(51) Int. Cl.
*A41C 3/12* (2006.01)
*A41C 3/00* (2006.01)

(52) U.S. Cl. ..... 450/89; 450/88; 450/36; 2/247

(58) Field of Classification Search ..... 450/1, 450/86, 88, 89, 36; 2/247–253, 102, 105, 2/114, 106, 115, 69, 94, 113, 93; 604/174, 604/179, 345, 118, 119, 73, 74; 128/875–877, 128/879; 600/388–390
See application file for complete search history.

(56) References Cited

U.S. PATENT DOCUMENTS 4,504,267 A * 3/1985 Parmelee et al. ..... 604/134
4,666,432 A * 5/1987 McNeish et al. ..... 604/174
5,708,978 A * 1/1998 Johnsrud ..... 2/102
6,390,885 B1 * 5/2002 Brooks ..... 450/1

* cited by examiner

*Primary Examiner*—Gloria M. Hale
(74) *Attorney, Agent, or Firm*—Donald W. Meeker

(57) ABSTRACT

A combination sports bra and secure pocket garment has a front mounted three section pocket with a single zipper closure. A cord hole in the pocket and a cord loop on the bra enables a cord to be retained from an electronic device in the closed pocket to a headset on the wearer.

6 Claims, 3 Drawing Sheets

SPORTS BRA WITH SECURE POCKET AND ELECTRONIC DEVICE CORD SECURING OPENING AND LOOP

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to sports garments and particularly to a sports bra or tank having a zippered pocket with three compartments and a cord aperture for carrying a portable digital audio player, the garment further comprises a headset cord securing loop.

2. Description of Related Art Including Information Disclosed Under 37 CFR 1.97 and 1.98

Many women enjoy listening to music while working out or jogging, but find that when wearing a sports bra, they have no place to store their MP3® player or iPod®. Some manufacturers of a portable digital audio player include clips for securing the device to the user's clothing, but the clips do not hold securely and there is a risk of dropping and damaging the electronic music player. Armbands, such as the DLO Action Jacket iPod® Armband are also provided, but may be uncomfortable or leave an odd tan line for those women who enjoy activities outdoors. Sports bras with pockets are also known, but do not have a means for securing the headset cord.

U.S. Patent Application No. 20020100108, published Aug. 1, 2002 by Stuart, shows athletic apparel having one or more pocket locations along the midsagittal plane of the wearer. During exercise or other activities, items are more comfortably and securely stored in pockets along the centerline of the body than in pockets located elsewhere on the body. Pocket locations overlying major muscle groups are avoided, reducing movement of items in the pockets during movement, and thereby avoiding distraction of the wearer and damage to items stored in the pockets.

U.S. Patent Application #20040009731, published Jan. 15, 2004 by Rabinowicz, claims a garment, such as a sports bra, a t-shirt, a tank top, shorts, or the like, with discrete integrally-formed, electrically-conductive regions and a pocket for holding an electronic device, such as a heart monitor.

U.S. Patent Application #20050246823, published Nov. 10, 2005 by Groom, indicates specialized clothing capable of securing electronic devices. A pocket for accepting various devices or other items is sewn or otherwise embodied within the article of clothing. The clothing is easily manufactured and the pockets may be deployed in various configurations to accept and retain a wide variety of devices and other objects. Further, the pockets are designed to provide a secure and snug fit around the device to lessen movement during various activities such as exercising. The pockets may also contain a specially configured tab for accepting and routing wires and cords associated with, for example, electronic devices for playing music.

U.S. Pat. No. 6,176,761, issued Jan. 23, 2001 to Underhill, is for a sports bra with a storage pouch. The sports bra has a pair of cups joined by a cleavage portion between the proximate edges of the cups and a back strap portion between the distal edges of the cups. The cups and cleavage portion are made of cloth having substantially universal elasticity so as to provide adequate support. A rectangular panel made of cloth having substantially universal elasticity is fastened along its bottom and side edges to an inside wall of the cleavage portion of the bra to form a storage pouch of approximately credit card dimensions. A plurality of short hook and loop segments extending substantially fully across the upper inside edge of the panel with mating segments of hook and loop material oppositely fixed along the inside wall of the cleavage portion of the bra allows the pouch to be completely sealed while still affording the desired universal elasticity. Preferably, the panel is made of back-to-back pieces of cloth with the inner one being non-absorbent and the cleavage portion is also made of back-to-back pieces of cloth with the inner one being non-absorbent so as to allow the sports bra to be fully absorbent along its body contact surfaces and yet provide a no-absorbent storage pouch to protect its contents. A flat member may be disposed between the panel cloths to stiffen the storage pouch.

U.S. Pat. No. 6,517,410, issued Feb. 11, 2003 to Underhill, provides a sports bra with a floating storage pouch. The front portion of the sports bra has a lining and a decorative cloth. A flat pocket lies over the opposite side of the lining as the decorative cloth. A cloth cover lies over the pocket. The bottom of the pocket is seamed to the bottom of the cover without stitching the lining or the decorative cloth and the sides of the cover are seamed to the lining without stitching the pocket or the decorative cloth so that the pocket floats in relation to the lining and decorative cover. The lining and cover are of universally stretchable absorbent material and the decorative cloth is of universally stretchable wicking material. The stretch affords the desired support from the bra, the absorbency collects the wearer's perspiration and the wicking draws the absorbed moisture to the outside for evaporation. The floating pocket provides a comfortable pouch for concealing articles within the bra.

U.S. Pat. No. 2,503,847, issued Apr. 11, 1950 to Shanahan, indicates a bra with a concealed storage pocket for a hearing aid transmitting apparatus.

U.S. Pat. No. 6,626,733, issued Sep. 30, 2003 to Knutson, shows a sports top with built-in bottle holder. The sports top is adapted for releasably holding a fluid container. The sports top includes a body fabric for being worn on an upper torso of a wearer. The body fabric has a front and back joined together and defining a pair of armholes and a neck hole. A pocket panel is formed with the back of the body fabric, and cooperates with the body fabric to form a pocket. The pocket has an open mouth, closed sides, and a bottom. A shape-retaining insert opens the mouth of the pocket such that the fluid container is readily inserted by the wearer into the pocket of the sports top during wear.

U.S. Pat. No. 6,099,382, issued Aug. 8, 2000 to Wilson, claims a sports brassiere constructed of stretchable material and formed to have a torso-encircling member having a front and rear portion. The front portion supports a liner member positioned against the breasts of the wearer with a pocket carried by the liner member and positioned substantially between the breasts of the wearer so as to be easily reachable by the wearer. A strip of stretchable material is affixed to the rear portion of the torso-encircling member and is affixed at each of its ends to the body portion so as to provide a strap or loop. The pocket and the loop provide means to carry articles desired by the wearer.

U.S. Pat. No. D408,963, issued May 4, 1999 to Consolo, describes the ornamental design for a brassiere with a pocket for a cordless telephone.

U.S. Pat. No. 2,436,430, issued Feb. 24, 1948 to Hart, discloses a brassiere with a pocket adapted to hold a hearing aid amplifier unit. The brassiere is provided with cord holding tabs for the purpose of holding the hearing aid cords in a less conspicuous position.

U.S. Pat. No. 3,078,852, issued Feb. 26, 1963 to Stapleton, puts forth a brassiere having a hidden storage pocket located between the cups of the bra. The storage pocket has an interlacing-type fastener at the top closure.

U.S. Pat. No. 1,900,129, issued Mar. 7, 1933 to Ring, concerns a woman's undergarment with pockets for concealing a transmitter, battery and tone control device for a telephone.

U.S. Pat. No. 2,492,862, issued Dec. 27, 1949 to Harvey, illustrates a pocket-equipped brassiere having a horizontally-oriented zippered pocket located in the front of its lower torso encircling band.

U.S. Pat. No. 2,593,711, issued Apr. 22, 1952 to Weatherly, is for a pocketed brassiere wherein the pocket is located between the cups of the bra and has a vertically-oriented zippered closure.

U.S. Pat. No. 2,624,881, issued Jan. 13, 1953 to Lee, provides a coin halter for a young girl, which comprises a chest-encircling band with shoulder straps and a zippered pocket for holding coins.

What is needed is a multiple section pocket for holding different items conveniently positioned on the upper front of the sports bra with a single zipper top opening, a cord hole in the pocket and a cord loop on the bra so that an electronic device in the pocket is attachable to headphones worn by the user.

BRIEF SUMMARY OF THE INVENTION

An object of the present invention is to provide a three section pocket for holding different items conveniently positioned on the upper front of the sports bra with a single zipper top opening, a cord hole in the pocket and a cord loop on the bra so that an electronic device in the pocket is attachable to headphones worn by the user with the pocket positioned sufficiently high so that the pocket is easily accessible by a user during exercise and so that a cord from the pocket reaches headphones worn by the user with the cord retained from moving around by the cord loop.

An advantage of the present invention is that it allows a wearer to securely carry electronic devices in the secure pocket with hands and arms free while engaging in activities such as sports.

Another advantage of the present invention is that the cord receiving opening and cord retaining loop maintain the cord close to the body so the wearer doesn't have the problems associated with a loose cord flying around.

One more advantage of the present invention is that the secure pocket is easily accessible for containing any items necessary or useful to a wearer engaged in activities including sports.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
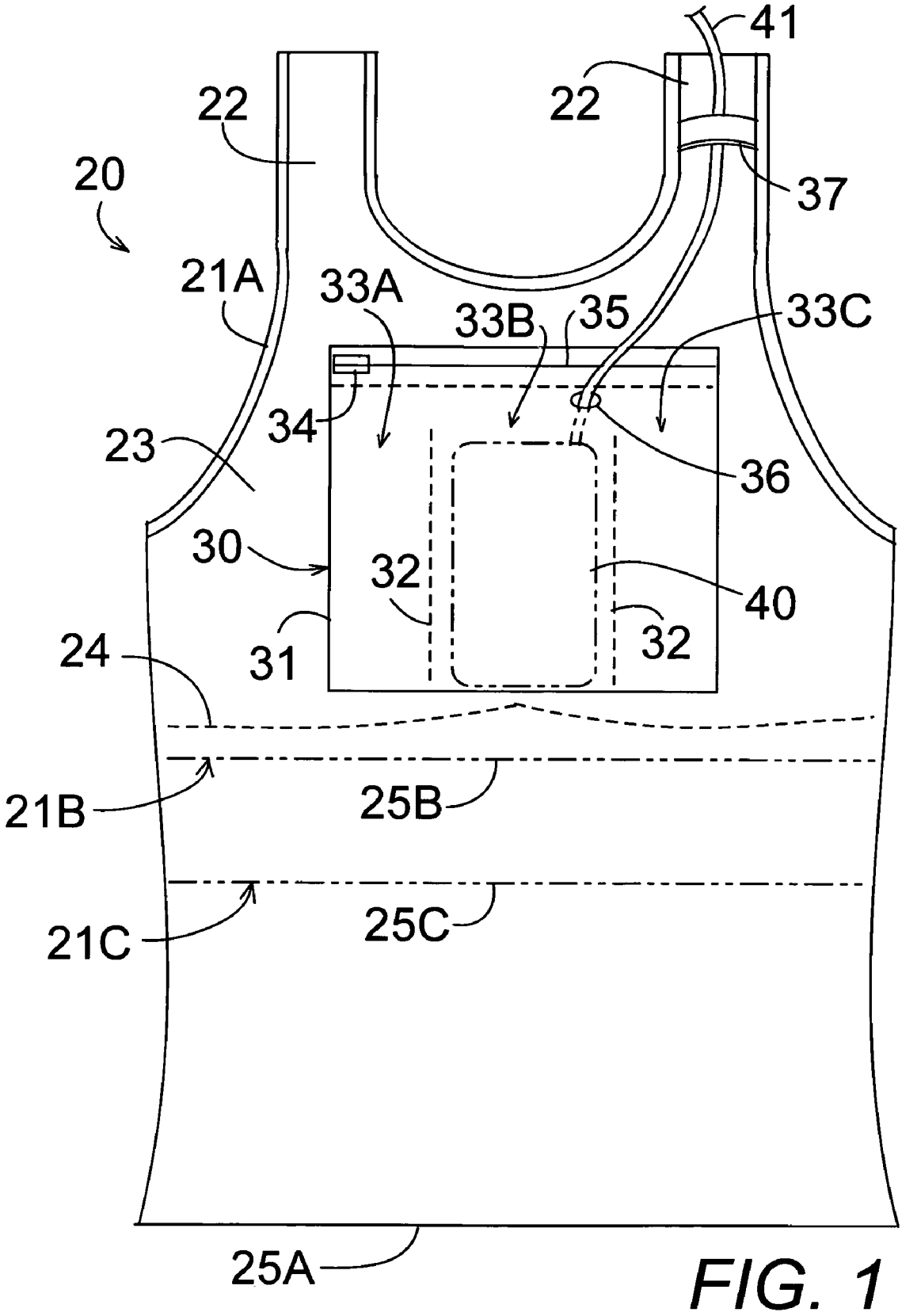
FIG. 1 is a front elevational view of the combination sports bra and secure pocket of the present invention showing an extended body version in solid lines and alternate shorter versions with dashed lines and showing the cord securing loop attached to one of the broad shoulder supports.
Figure 2:
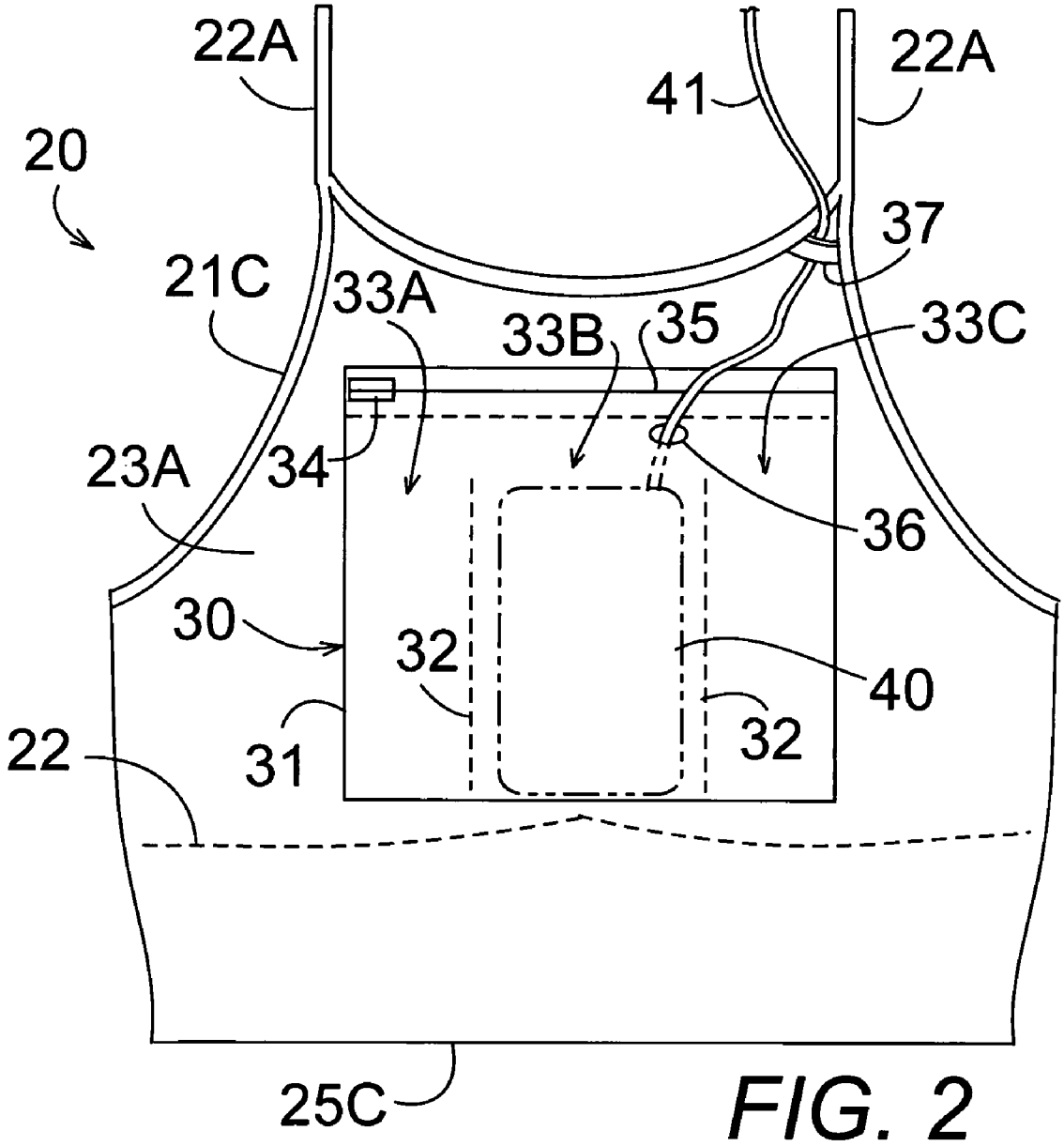
FIG. 2 is a front elevational view of one of the combination sports bras with a secure pocket of the present invention showing an intermediate length body version with narrow shoulder strap portions and showing the cord securing loop attached to the body encircling portion.
Figure 3:
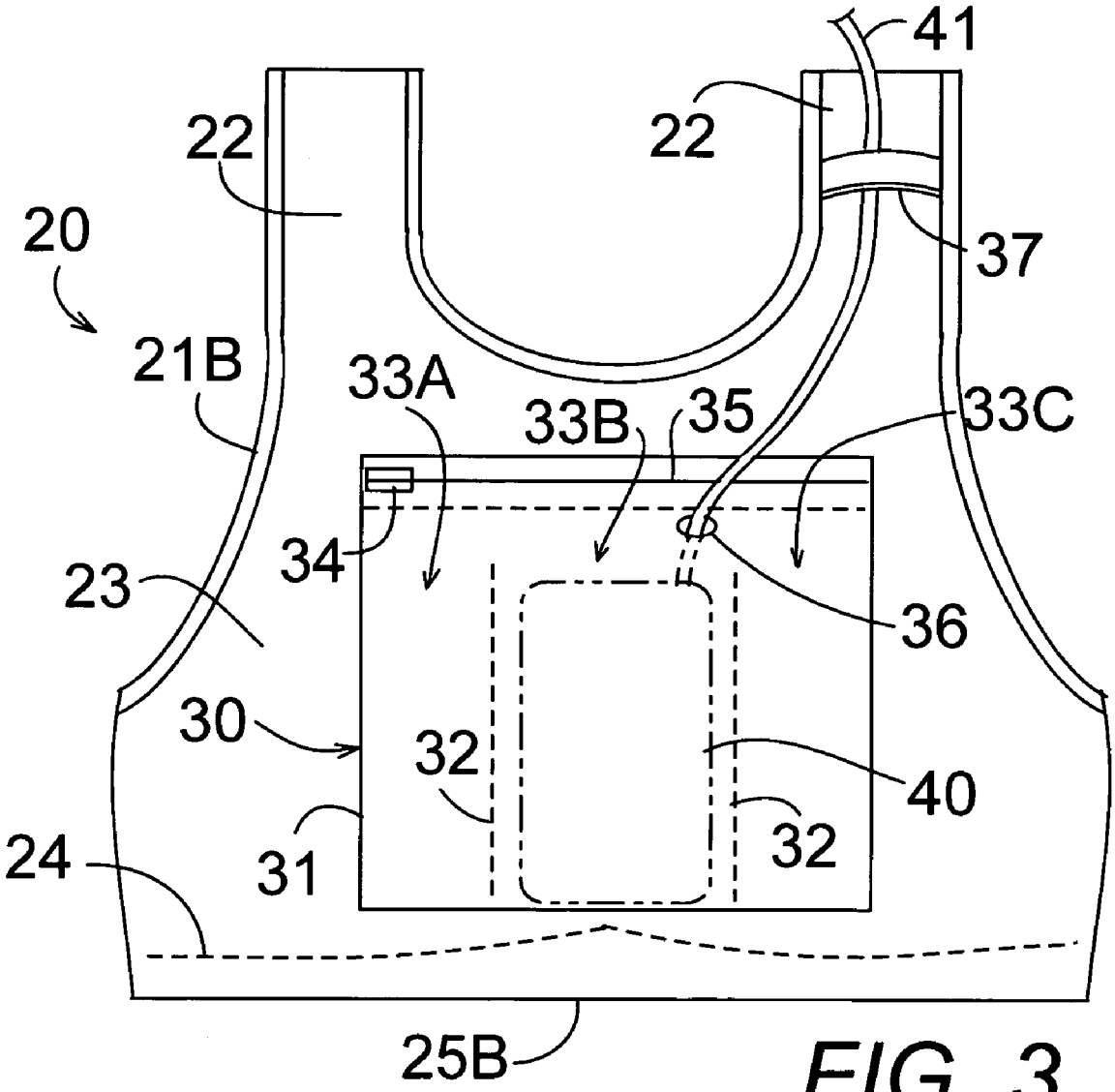
FIG. 3 is a front elevational view of one of the combination sports bras with a secure pocket of the present invention showing a short length body version with wide shoulder strap portions and showing the cord securing loop attached to one of the broad shoulder supports.

In FIGS. 1-3, a sports bra 20 and secure pocket 30 combination garment for carrying items such as electronic equipment 40, such as a music playing device, radio, cell phone, or other type of electronic device producing sound, holds the items securely while the wearer is engaging in athletic activity.

The sports bra 21A, 21B, and 21C comprises a body encircling portion 23 and 23A having means for supporting the breasts of a wearer, such as built-in elasticized support material 24 and a pair of shoulder strap portions 22 and 22A to assist in supporting the sports bra on the wearer.

The secure pocket 30 is positioned on an upper front portion of the sports bra for holding different items therein in a conveniently accessed location while a wearer is engaged in sports or other activities. The pocket comprises at least one interior space, and preferably three interior spaces 33A, 33B, and 33C or compartments, for receiving and securing items therein including a space 33B for securing an electronic device 40 therein. A single pocket opening 35 at a top of the pocket communicates with all three interior spaces or compartments 33A, 33B and 33C. A means for reversibly closing the pocket opening preferably comprises a zipper 34 or other easy to use securing means to secure items carried in the pocket 30 during activity by the wearer.

The secure pocket 30 is divided into at least two compartments, and preferably three compartments or interior spaces 33A, 33B, and 33C, formed by a barrier created by stitching a front and back of the pocket together in a vertical stitching line 32, preferably two stitching lines 32, between the compartments to form three compartments or interior spaces 33A, 33B, and 33C, wherein one of the compartments or interior spaces 33B secures an electronic device 40 therein and the compartments are all accessed by the single top opening 35.

A small cord receiving hole 36 through the outside of the pocket is positioned adjacent to a top of the pocket 35. The cord receiving opening 36 is only large enough to receive a sound cord 41 and a sound cord plug therethrough so that a cord attached to an electronic device 40 in the closed pocket can pass through the cord receiving hole 36 and connect to a listening device in an ear of the wearer.

A cord retaining loop 37 attached to the sports bra spaced apart from the pocket 30 above the pocket between the pocket and the head of the user for receiving the sound cord 41 therethrough to retain the sound cord in place on the sports bra during active movement of the wearer. In FIGS. 1 and 3, the cord retaining loop 37 is attached to at least one of the pair of shoulder strap portions 22 of the sports bra 21A and 21B having broad shoulder strap portions. In FIG. 2, the cord retaining loop 37 is attached to body encircling portion 23A of the sports bra because the shoulder strap portions 22A of this type of sports bra are too narrow.

The sports bra is preferably fabricated with an outer portion of 88% Polyester and 12% spandex to be self supporting with a tension fit and having an inside floating lining of 85% nylon and 15% spandex and the secure pocket of 88% Polyester and 12% spandex. An inside liner may be used with an elastic band for extra support. The sports bra may be manufactured in any desired length including a long body version 21A of FIG. 1, a mid-size body version 21C of FIG. 2, and a short body version 21B of FIG. 3.

It is understood that the preceding description is given merely by way of illustration and not in limitation of the invention and that various modifications may be made thereto without departing from the spirit of the invention as claimed.

What is claimed is:

1. A sports bra and secure pocket combination garment for carrying items such as electronic equipment securely while engaging in athletic activity, the garment comprising in combination:

a sports bra comprising a body encircling upper body clothing portion having interior elasticized means for supporting the breasts of a wearer and a pair of shoulder strap portions to assist in supporting the sports bra on the wearer;

a secure pocket positioned on an upper front portion of the sports bra for holding different items therein while a wearer is engaged in activities, the secure pocket comprising at least one interior space for receiving and securing items therein including a space for securing an electronic device therein, a pocket opening at a top of the secure pocket communicating with the at least one interior space, a fastener means for reversibly closing the secure pocket opening to secure items carried in the secure pocket during activity by the wearer, a small cord receiving hole in the secure pocket adjacent to a top of the secure pocket, the cord receiving hole only large enough to receive a sound cord and a sound cord plug therethrough so that a cord attached to an electronic device in the closed secure pocket can pass through the cord receiving hole and connect to a listening device in an ear of the wearer;

a cord retaining loop attached to the sports bra spaced apart from the pocket above the secure pocket between the secure pocket and the head of the user for receiving the sound cord therethrough to retain the sound cord in place on the sports bra during active movement of the wearer.

2. The combination garment of claim 1 wherein the secure pocket is divided into at least two compartments formed by a barrier created by stitching a front and back of the secure pocket together in a vertical line between the compartments, wherein one of the compartments comprises the at least one interior space for securing an electronic device therein and the compartments are all accessed by a single top opening.

3. The combination garment of claim 2 wherein two spaced vertical barriers form three compartments within the secure pocket, all three compartments accessed by the pocket opening.

4. The combination garment of claim 1 wherein the means for reversibly closing the pocket opening comprises a zipper.

5. The combination garment of claim 1 wherein the cord retaining loop is attached to the body encircling portion of the sports bra.

6. The combination garment of claim 1 wherein the cord retaining loop is attached to at least one of the pair of shoulder strap portions of the sports bra.

* * * * *